US010993518B2

(12) United States Patent
Chang

(10) Patent No.: US 10,993,518 B2
(45) Date of Patent: May 4, 2021

(54) HAIR-DRYING HOOD AND HAIR TREATMENT DEVICE INCLUDING THE SAME

(71) Applicant: Stephanie Chang, Herndon, VA (US)

(72) Inventor: Stephanie Chang, Herndon, VA (US)

( * ) Notice: Subject to any disclaimer, the term of this patent is extended or adjusted under 35 U.S.C. 154(b) by 84 days.

(21) Appl. No.: 16/439,955

(22) Filed: Jun. 13, 2019

(65) Prior Publication Data

US 2020/0390218 A1 Dec. 17, 2020

(51) Int. Cl.

| | |
|---|---|
| ***A45D 20/12*** | (2006.01) |
| ***A45D 20/14*** | (2006.01) |
| ***A45D 20/22*** | (2006.01) |
| ***A45D 20/18*** | (2006.01) |

(52) U.S. Cl.

CPC ..... *A45D 20/14* (2013.01); *A45D 20/18* (2013.01); *A45D 20/22* (2013.01); *A45D 2200/205* (2013.01)

(58) Field of Classification Search

CPC ..... A45D 20/14; A45D 20/24; A45D 20/44; A45D 20/20; A45D 20/22; A45D 20/18; A45D 20/04; A45D 20/32; A45D 2200/205

USPC ..... 34/99, 97, 546, 554, 283

See application file for complete search history.

(56) References Cited

U.S. PATENT DOCUMENTS

| | | | | | |
|---|---|---|---|---|---|
| 2,295,824 | A * | 9/1942 | Batsel | A45D 20/00 | 34/99 |
| 3,073,037 | A * | 1/1963 | Fay | A45D 20/18 | 34/99 |
| 3,708,803 | A * | 1/1973 | Teaff | A42B 1/201 | 2/171.01 |
| 5,064,154 | A * | 11/1991 | Payne | A45D 20/12 | 248/121 |
| 5,279,048 | A * | 1/1994 | Lawall | A45D 20/12 | 34/90 |
| 5,692,315 | A * | 12/1997 | Sham | A45D 19/16 | 34/99 |
| 2009/0282691 | A1* | 11/2009 | Anicetti | A45D 20/12 | 34/97 |
| 2017/0127804 | A1* | 5/2017 | Lee | A45D 20/04 | |

* cited by examiner

*Primary Examiner* — John P McCormack

(74) *Attorney, Agent, or Firm* — WPAT, PC

(57) ABSTRACT

A hair treatment device can be used with a blower for drying and styling hair. The hair treatment device includes a hair-drying hood for covering the head of a user, which has an opening at a top portion or a side portion thereof. The blower can be inserted from the opening. The hair-drying hood further includes an outer layer, where the opening is disposed, and a thermal layer, which forms an air flow guiding chamber together with the outer layer inbetween for introducing and dispersing hot air from the blower all over the hair-drying hood while raising a temperature of the thermal layer. The hair treatment device further includes a position retainer having a first end fixing the blower, and having a second end is stably fixed onto an object.

18 Claims, 13 Drawing Sheets

HAIR-DRYING HOOD AND HAIR TREATMENT DEVICE INCLUDING THE SAME

FIELD OF THE INVENTION

The present invention relates to a hair-drying hood and a hair treatment device including a hair-drying hood, and more particularly to a hair-drying hood and a hair treatment device including a hair-drying hood for use with a blower.

BACKGROUND OF THE INVENTION

Hair style is an important part of fashion, so people need to take care of it from time to time. The most common thing to do is to use a hair dryer to evaporate water in the hair. A hair dryer needs a user to hold it with his hand, and it is necessary to change positions frequently to make the hair evenly exposed to wind and heat, which will cause inconvenience to the user. To improve such disadvantages, a variety of hair-drying devices have been developed.

Please refer to FIG. 1A, which is a schematic view showing the appearance of a conventional household hair drying device. A base 91 is provided with a blower module (not shown) for generating a hot air flow, which is delivered to a hair hood 93 through a tubular passage (not shown) in a bracket 92, so that hair in the hair hood 93 can be dried. Disadvantageously, such products are too bulky and heavy to be carried for traveling. Even if the bracket 92 can be folded so that the base 91 and the head hood 93 can be combined, it is still difficult to achieve the requirements for portability. Moreover, the transmission path between the blower module in the base 91 and the head hood 93 is too long to be efficient for drying, and too much energy consumption is caused.

Referring to FIG. 1B, another conventional hair drying device is schematically illustrated, wherein most of the objects are made of cloth, so that it can be conveniently stored and carried. A duct 95 is sleeved on an air outlet (not shown) of the blower for guiding hot air into a hair hood 94, so that the user's hair placed in the hair hood 94 can be heated to achieve the purpose of drying. However, as can be seen from the figure, the hot air flow entering the hair hood 94 and temporarily staying therein will cause the internal air pressure to rise. As a result, it is not easy for the hair hood 94 to remain on the user's head. Therefore, the hair hood 94 must be provided with a strap set 940 for fixing the hair hood to the user's head. The user likely feels uncomfortable because the strap set 940 is wrapped around the forehead and neck.

FIG. 1C is a schematic view showing the appearance of still another conventional hair drying device, wherein the hair hood 96 itself is integrated with a blower module (not shown). The hair hood 96 standing through a stand 97 can be used for drying hair placed in the hair hood 96. In spite the transfer path between the blower module and the hood 93 is efficient, the size and weight still fail to meet the requirements for portability.

SUMMARY OF THE INVENTION

For alleviating the drawbacks of the aforementioned prior art, a hair treatment device is developed for use with a blower, and comprising: a hair-drying hood for covering the head of a user, the hair-drying hood having an opening at a top portion or a side portion thereof, from which the blower is inserted, and further comprising an outer layer, where the opening is disposed, and a thermal layer, which forms an air flow guiding chamber together with the outer layer in between for introducing and dispersing hot air from the blower all over the hair-drying hood while raising a temperature of the thermal layer; and a position retainer having one end fixing the blower, and having another end is stably fixed onto an object.

The hair treatment device is described as above, wherein an edge of the opening of the hair-drying hood is surrounded with a securing strap for assuring of fixing an air outlet of the blower to the hair-drying hood.

The hair treatment device is described as above, wherein two sides of the opening of the hair-drying hood are coupled with a securing strap for assuring of fixing the hair-drying hood to the blower.

The hair treatment device is described as above, wherein the outer layer is made of a heat-insulating material, and the thermal layer is distributed with a plurality of pores, which the hot air evenly penetrates through to reach hair of the user.

The hair treatment device is described as above, wherein the outer layer is further disposed with a frame structure inserted in the outer layer to have the outer layer switchable between a retracted state and a working state.

The hair treatment device is described as above, wherein the frame structure is formed of a spiral metal wire, and switched from the retracted state to the working state while expanding as a result of gravity.

The hair treatment device is described as above, wherein the thermal layer is not porous, but is heat-conductive itself so that heat energy can be radiated evenly to hair, and the thermal layer is disposed with an outlet at a bottom portion thereof, where the outer layer is coupled, for exhausting air.

The hair treatment device is described as above, wherein a coupling position of the outer layer and the thermal layer are coupled thereto a net structure or a plurality of strings, and the coupling position is near the opening at the top portion of the hair-drying hood.

The hair treatment device is described as above, wherein the hair-drying hood further includes an air flow passage structure, which has an air inlet in communication with the opening, an air outlet in communication with the air flow guiding chamber for guiding hot air inputted from the air inlet toward the air flow guiding chamber, and a stopper structure, disposed at a bottom portion of the air inlet for stopping a front end of the blower from entering deep.

The hair treatment device is described as above, wherein the air flow passage structure is further disposed with a flow-guiding plate, which is cone-shaped for evenly guiding downward blowing hot air toward the air outlet along a surficial slope thereof into the air flow guiding chamber, and wherein the air flow passage structure is made of a cloth that is easy to be folded and stored.

The hair treatment device is described as above, wherein the position retainer is a stand fixed on to a floor, and a height thereof is adjustable, and an orientation of the blower is changeable by rotating the end fixing the blower.

The hair treatment device is described as above, wherein the position retainer having a first end used for fixing the bower, and a second end, which is a powerful spring clip for stably clamping the object, and wherein a main body between the first end and the second end is a tubular body, which can be secured in a bent shape and is resilient to deformation.

The hair treatment device is described as above, wherein a first end of the position retainer is for hanging the hair-drying hood inserted therein the blower, and the second end is an arch-shaped hook for stably clamping the object, which is a door plate.

Another aspect of the invention relates to a hair-drying hood for use with a blower, which comprises: n outer layer having an opening at a top portion or a side portion thereof for inserting therefrom the blower; and a thermal layer forming an air flow guiding chamber together with the outer layer in between for introducing and dispersing hot air from the blower all over the hair-drying hood while raising a temperature of the thermal layer, and the outer layer and the thermal layer are switchable between a retracted state and a working state.

The hair-drying hood is described as above, which further comprises a frame structure coupled to the outer layer to have the outer layer switchable between a retracted state and a working state.

The hair-drying hood is described as above, wherein the frame structure is formed of a spiral metal wire, and switched from the retracted state to the working state while expanding as a result of gravity.

The hair-drying hood is described as above, wherein an edge of the opening is surrounded with a first securing strap for fixing an air outlet of the blower to the hair-drying hood, and wherein two sides of the opening are disposed with a second securing strap for fixing the hair-drying hood to the blower.

The hair-drying hood is described as above, wherein the outer layer is made of a heat-insulating material, and the thermal layer is distributed with a plurality of pores, which the hot air evenly penetrates through to reach hair of the user.

The hair-drying hood is described as above, wherein the thermal layer is not porous, but is heat-conductive itself so that heat energy can be radiated evenly to hair, and the thermal layer is disposed with an outlet at a bottom portion thereof, where the outer layer is coupled, for exhausting air.

The hair-drying hood is described as above, wherein a coupling position of the outer layer and the thermal layer are coupled thereto a net structure or a plurality of strings, and the coupling position is near the opening at the top portion of the hair-drying hood.

The hair-drying hood is described as above, wherein the hair-drying hood further includes an air flow passage structure, which has an air inlet in communication with the opening, an air outlet in communication with the air flow guiding chamber for guiding hot air inputted from the air inlet toward the air flow guiding chamber, and a stopper structure, disposed at a bottom portion of the air inlet for stopping a front end of the blower from entering deep.

The hair-drying hood is described as above, wherein the air flow passage structure is further disposed with a flow-guiding plate, which is cone-shaped for evenly guiding downward blowing hot air toward the air outlet along a surficial slope thereof into the air flow guiding chamber, and wherein the air flow passage structure is made of a cloth that is easy to be folded and stored.

A hair treatment device and a hair-drying hood included therein according to the present invention are principally advantageously in uniform and quick heating, easy storage and hand-free operation, and exempting from uncomfortable feeling of the user, and are therefore particularly suitable to be used at home or travelling.

BRIEF DESCRIPTIONS OF DRAWINGS

DETAILED DESCRIPTIONS OF THE INVENTION

Figure 1A:
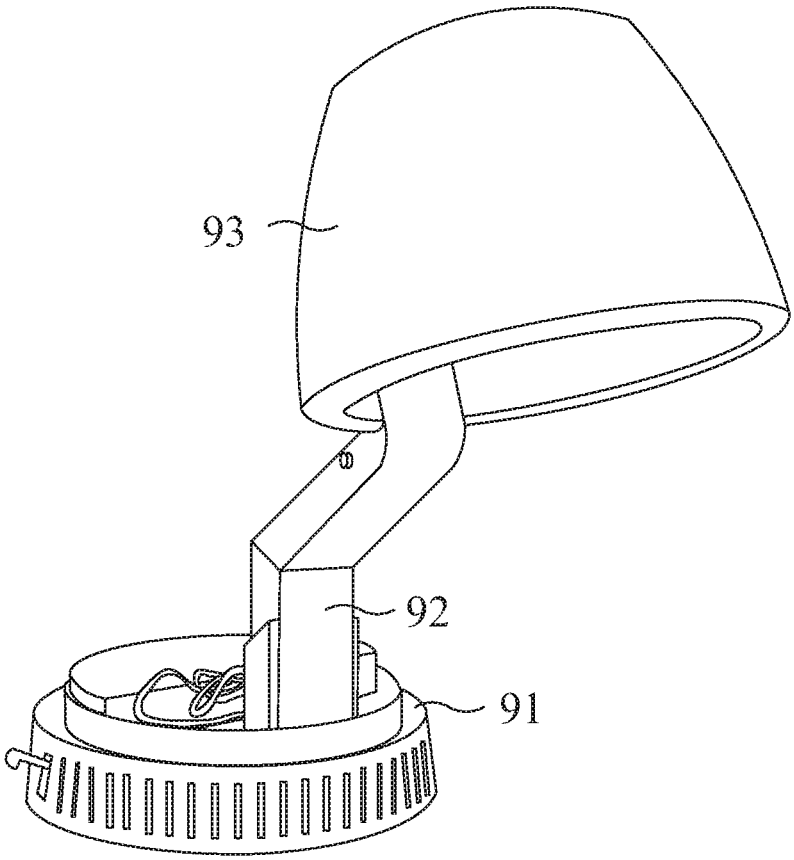
FIGS. 1A, 1B and 1C are schematic diagrams illustrating the appearances of three conventional prior art of hair treatment devices.
Figure 1B:
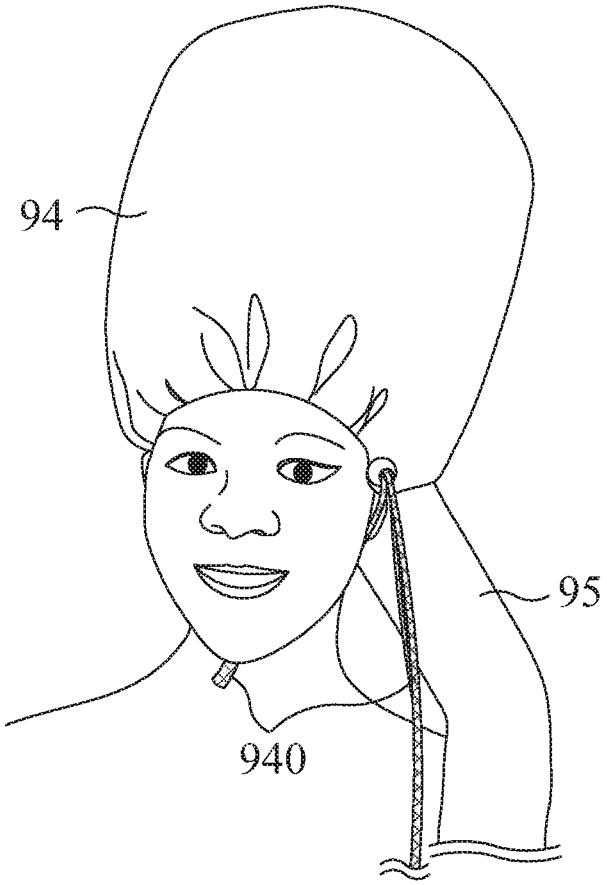
Figure 1C:
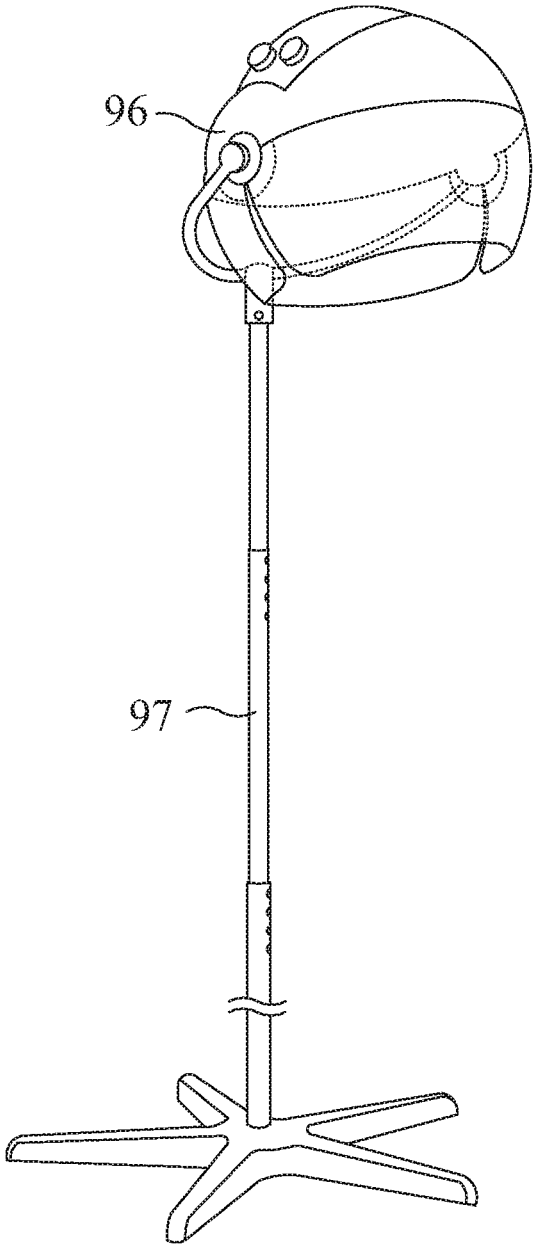
Figure 2A:
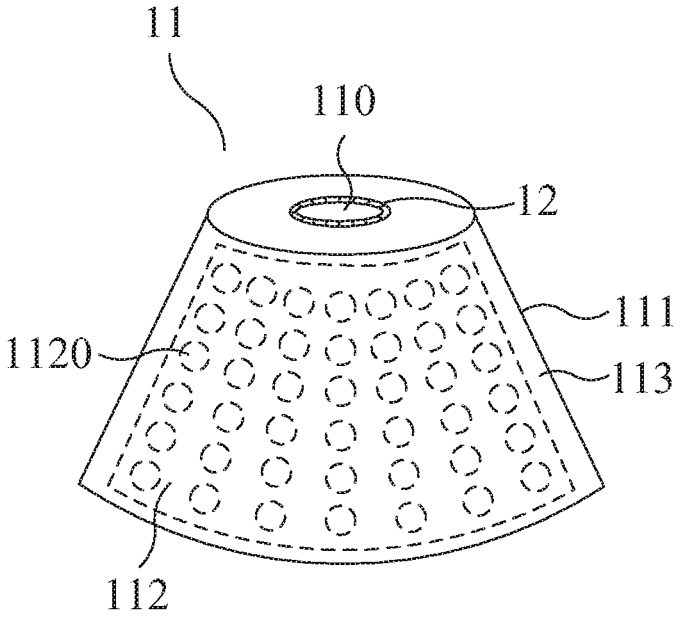
FIG. 2A is a schematic diagram illustrating a first structure of a hair-drying hood of a hair treatment device developed by the present invention.

Please refer to FIG. 2A, which is a schematic diagram illustrating the structure of a hair-drying hood of a hair treatment device, which includes a hair dryer hood 11 for covering a user's head. Therefore, the hair-drying hood 11 is substantially designed to match the contour of a user's head, but is not limited to a particular shape. Depending on designs, the top view of the hair-drying hood 11 may be circular, elliptical, etc., and the cross-sectional view may be trapezoidal, rectangular or semi-circular.

For illustration purposes, the present embodiment is exemplified under a configuration with a circular top-view shape and a trapezoidal cross-sectional shape. A top portion of the hair-drying hood 11 is provided with an opening 110 for allowing a blower (not shown) or other hot air supply tube to be inserted. An elastic strap 12 is wrapped around the edge of the opening 110 for fixedly combining the air outlet of the blower, and the hair-drying hood 11, and is adapted for different outlet diameters of different blowers or other tubes. The hot air sent out of the air outlet of the blower can thus be introduced into the hair-drying hood 11.

In addition, the hair-drying hood 11 includes at least two layers. A first layer is an outer layer 111, and a second layer is a thermal layer 112. The opening 110 is located in the outer layer 111. Both the outer layer 111 and the thermal layer 112 may be formed of windproof and heat resistant artificial fabrics, and the outer layer structure 111 may be preferably made of an air impermeable and heat resistant insulating material. As for the thermal layer 112, pores 1120 through which airflow can pass are formed therein.

The elastic strap 12 is coupled to the outer layer 111 around the edge of the opening 110. The thermal layer 112 disposed within the outer layer 111 is joined to the outer layer 111 and an air flow guiding chamber 113 is formed therebetween for dispersing hot air entering from the opening 110 all over the hair-drying hood 11. The plural pores 1120 are distributed on the thermal layer 112 for allowing hot air to uniformly diffuse out of the airflow guiding chamber 113 and reach the user, thereby improving the hair-drying effect. Of course, in order to have better insulation and uniform heating effect, the thermal layer 112 may alternatively be implemented with a fabric comprising a metal mesh, which can be silver, titanium, or of course, any other metal or thermo-conductive material.

Figure 2B:
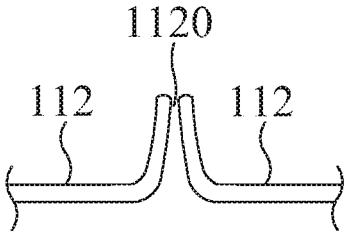
FIG. 2B is a schematic side view illustrating a structure of a pore in a hair-drying hood of the present invention.

A schematic side view of a pore 1120 can be as shown in FIG. 2B. A protruding cone 1121 is formed on the surface of the thermal layer 112, and the pore is formed at the tip of the cone 1121. The channel formed inside the cone 1121 has a decreasing width so that the exhaust of the hot air can be accelerated to achieve a better hair drying effect.

Figure 2C:
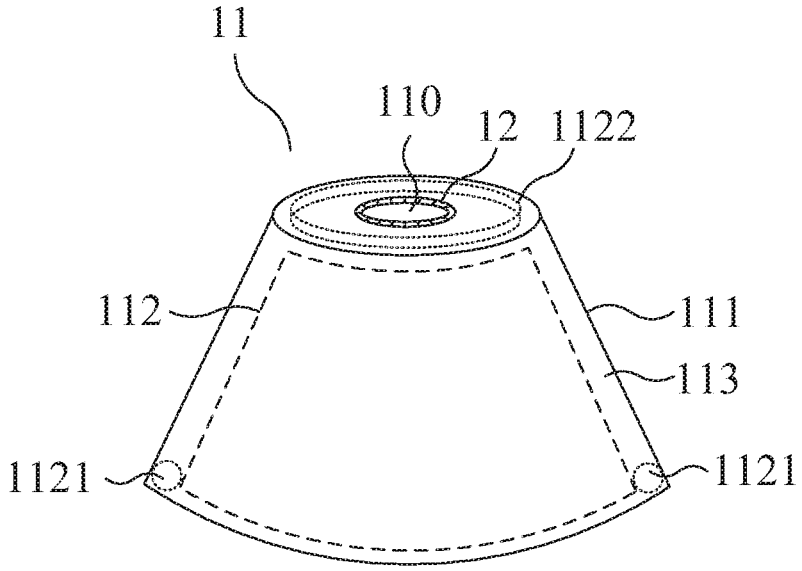
FIG. 2C is a schematic diagram illustrating a second structure of a hair-drying hood of a hair treatment device developed by the present invention.

Of course, alternatively as shown in FIG. 2C, which is a schematic diagram illustrating the structure of another hair-drying hood of a hair treatment device developed according to the present invention, and has a configuration similar to that shown in FIG. 2A, except that there is no pore 1120 on the surface of the thermal layer 112. The thermal energy is transmitted through the thermal conductance of the thermal layer 112 itself to uniformly radiate thermal energy to the hair. A modification is made to provide an outlet 1121 at a bottom portion of the thermal layer 112, where the outer layer 111 is combined. The outlet 1121 is provided for airflow to pass through. Furthermore, in order to keep the distance between the outer layer 111 and the thermal layer 112 below a specified value, and avoid the air flow guiding chamber 113 from expanding too much when the hot air is introduced, a mesh structure 1122 or a plurality of strings are sewn or coupled to where the outer layer 111 and the thermal layer 112 are jointed to confine the distance between the outer layer 111 and the thermal layer 112. A preferable joint position is at the top portion of the hair-drying hood 11, i.e. near the opening 110.

Figure 3A:
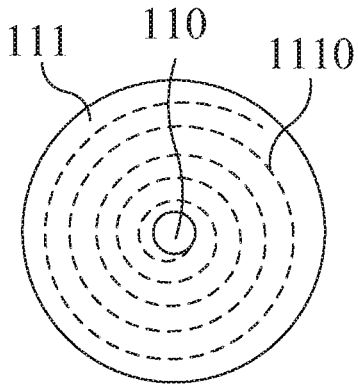
FIGS. 3A and 3B are schematic diagrams illustrating different views of a frame structure disposed in the outer layer.
Figure 3B:
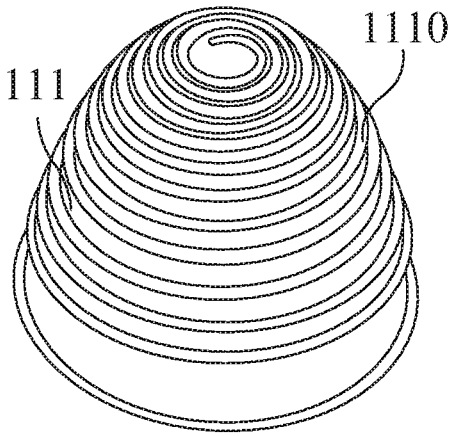

Please further refer to FIGS. 3A and 3B, which schematically illustrate the appearance of the structure of the hair-drying hood 1 including at least two layers, wherein the first layer is an outer layer 111 and the second layer is a thermal layer 112 overlying the frame structure 1110 of the outer layer 110. The frame structure 1110 can be designed as a spiral metal wire which can be sewn and fixed to the outer structure 111. FIG. 3A illustrates a state that the spiral metal wire is in a retracted state so that the outer layer 111 and the thermal layer 112 are flattened as well, and thus easily folded and stored. The state shown in FIG. 3B is a working state of the spiral metal wire, so that the outer layer 111 and the thermal layer 112 expand together with the spiral metal wire as a result of gravity. Of course, a tubular structure (not shown) may be selectively used in the outer layer 111 or the thermal layer 112 for frame structure 1110 implemented with the spiral metal wire to pass through and be fixed.

Figure 3C:
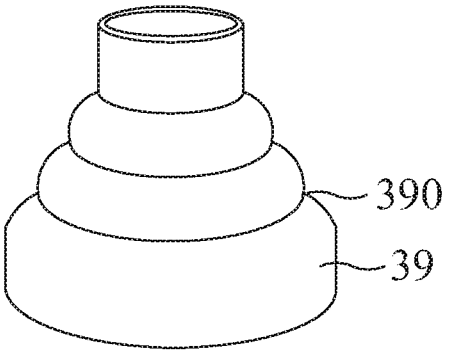
FIGS. 3C, 3D and 3E are schematic diagrams showing another embodiment of a retractable hair-drying hood, whose basic structure is the same as those disclosed in FIG. 2A and FIG. 2C.
Figure 3D:
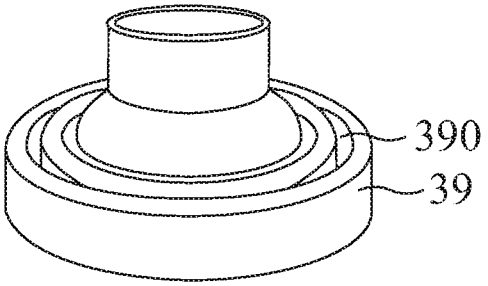
Figure 3E:
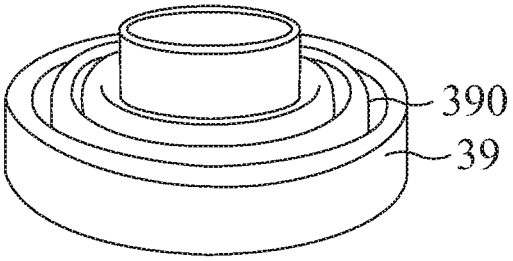

FIGS. 3C, 3D and 3E are schematic diagrams showing another embodiment of a retractable hair-drying hood, whose basic structure is the same as those disclosed in FIG. 2A and FIG. 2C. The hair-drying hood 39 of the embodiment is produced with a plurality of pressed annular creases 390. Therefore, the hair-drying hood 39 would be able to be retracted from a standing state as shown in FIG. 3C to a retracted state as shown in FIGS. 3D and 3E by way of the creases 390.

FIGS. 3C, 3D and 3E are schematic diagrams showing another embodiment of a retractable hair-drying hood, whose basic structure is the same as those disclosed in FIG. 2A and FIG. 2C. The hair-drying hood 39 of the embodiment is produced with a plurality of pressed annular creases 390. Therefore, the hair-drying hood 39 would be able to be retracted from a standing state as shown in FIG. 3C to a retracted state as shown in FIGS. 3D and 3E by way of the creases 390.

Figure 4:
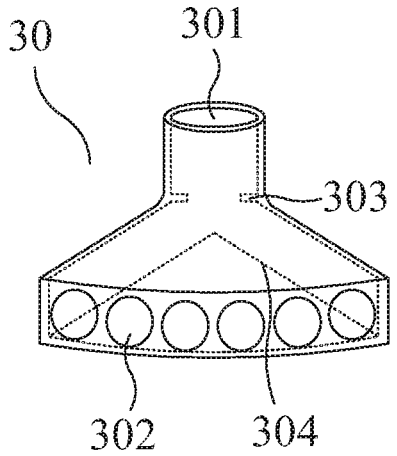
FIG. 4 is a schematic diagram illustrating an air flow passage structure additionally disposed in a hair treatment device of the present invention.
Figure 6:
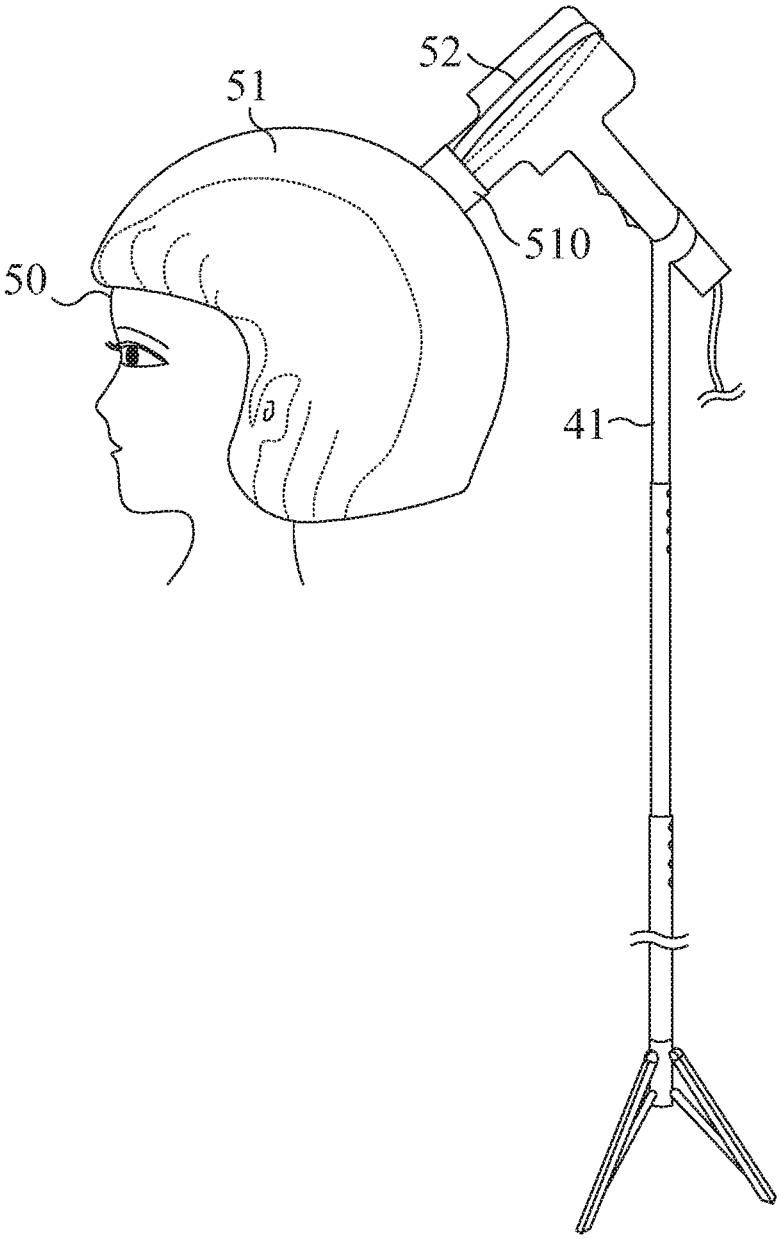
FIG. 6 is a schematic diagram illustrating the use of a hair treatment device assembled from a hair-drying hood of the present invention and a blower in another styling embodiment.

Please further refer to FIG. 6, which is a schematic diagram showing the use of another design embodiment of a hair treatment device produced by assembling a hair-drying hood and a blower according to the present invention. As can be seen from the figure, hair is commonly distributed in the top and rear regions of the skull of a user 50. Therefore, the hair-drying hood 51 is designed in a manner as shown to cover the top and the rear of the head, and at most further covering the forehead. In other words, it is similar to the appearance of a helmet. The air flow passage structure 30 as shown in FIG. 4 (not shown in this figure) and the frame structure 1110 as shown in FIG. 2A (not shown in this figure) may also be placed in the hair-drying hood 51, and other internal structures with reference to the above embodiments may also be disposed, which will not be described herein redundantly. In order to achieve a balance of weight distribution between combined blower 40 and hair-drying hood 51, the opening 510 of the hair-drying hood 51 may be disposed at a side portion as shown (instead of the right top portion). As a result, the blower 40 can be inserted into the air inlet 301 of the air flow channel structure 30 (not shown in the figure) in a non-vertical direction, and the front end of the blower 40 abuts against the stopper 303 of the air flow passage structure 30 (not shown in the figure). The elastic securing strap 52 fixed to both sides of the opening 510 of the hair-drying hood 51 can be used to fix the hair-drying hood 51 to the blower 40 of different sizes. In addition, a stand 41 may also be provided with one end fixing thereto the blower 40, and the other end standing stably on the ground or a table. In this way, the user can perform the blowing and hair-styling work without the need for holding the device with his hands, and does not require any additional coupling device to hold the device at the user's head, so as to avoid uncomfortable feeling of the user.

Furthermore, the hair-drying hood 51 can also be used for drying fur of a pet. The configuration and internal space may also be considered to be alternatively modified into a semi-oval shape or a rectangular cylindrical shape. The shape of the stand 41 may be referred to a tripod stand for use with a camera or a microphone stand. In addition to height adjustment, the stand 41 may also be provided with a shaft rotatable in X-axis, the Y-axis and the Z-axis at a joint with the blower 40 for allowing the user to conveniently change the orientation of the blower 40. Of course, in addition to the three-way shaft, a spherical bearing or a flexible coil device may alternatively be used to adjust the angle. In addition to the stand 41 described above, any other type of position retainer may be used.

Figure 7:
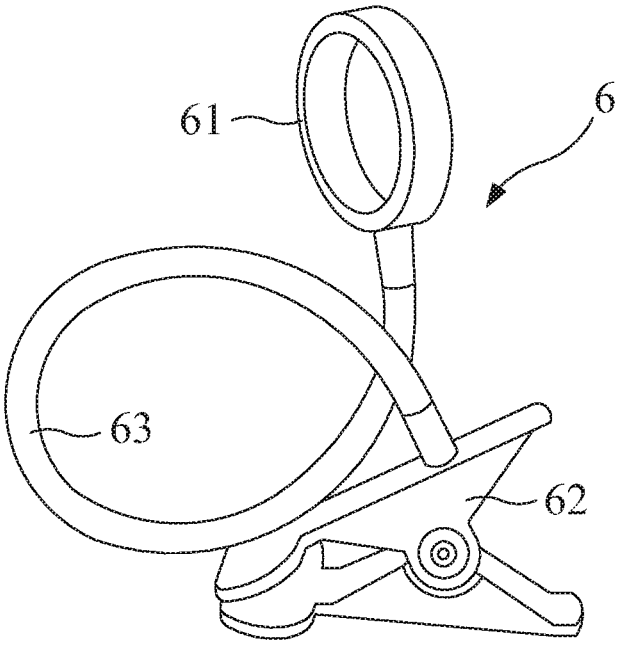
FIG. 7 is a schematic diagram illustrating the appearance of an embodiment of a position retainer according to the present invention.

Refer further to FIG. 7, which is a schematic diagram illustrating the appearance of a position retainer. A first end 61 of the position retainer 6, in this embodiment, is a ring member for the air outlet of the blower (not shown in the figure) to be sleeved and fixed, and a second end 62 stably clamps an object (not shown) with a strong spring clip, which may be a seat back, or an edge of a table or other furniture. The first end 61 of the position fixer 6 is used for retaining the blower (not shown in this figure), and the main body between the first end 61 and the second end 62 may be a bendable coiled tube 63 as shown or any other tubular structures, whose bent shape can be fixed while being resistant to deformation. In this way, the position retainer 6 can successfully play the role of fixing the hair-drying hood of the hair treatment device of the present invention in a proper working position.

Figure 8:
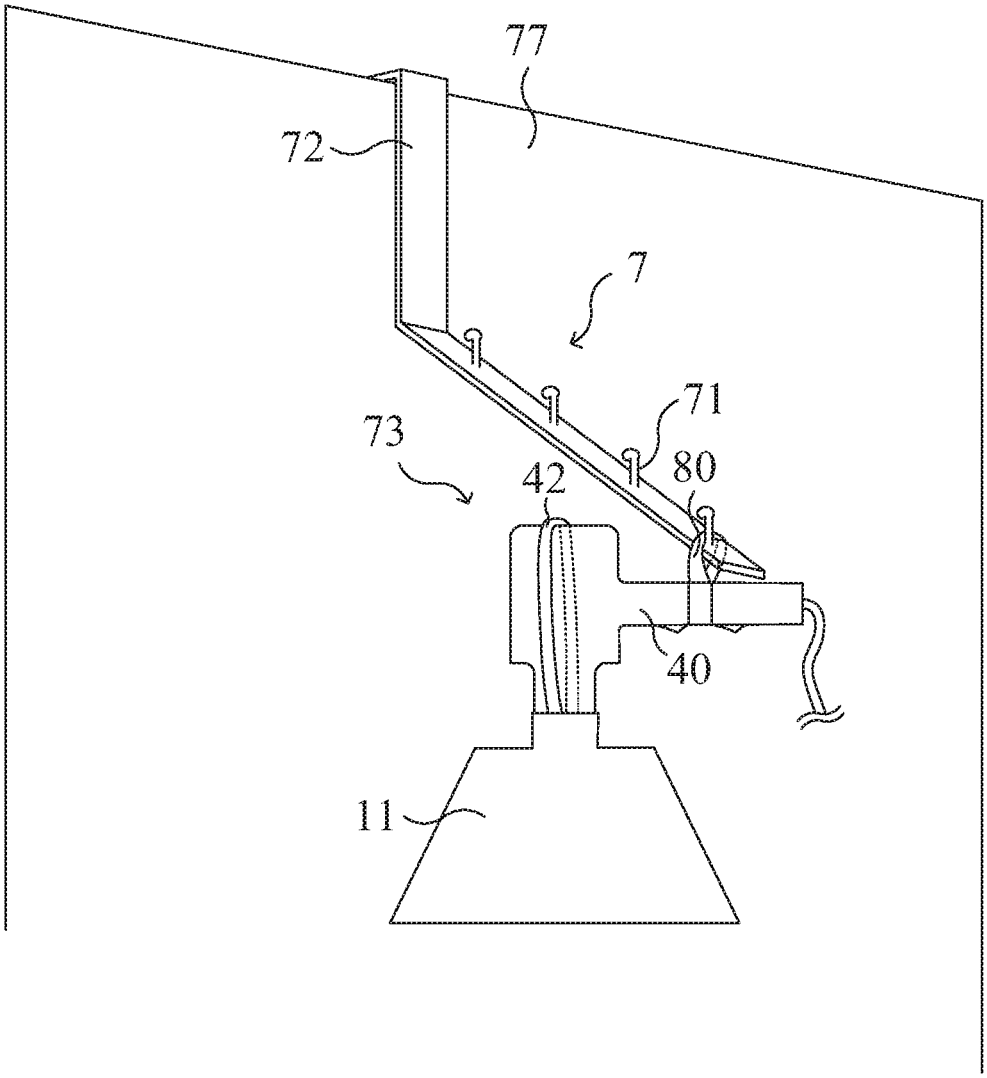
FIG. 8 is a schematic diagram illustrating the appearance of another embodiment of a position retainer according to the present invention.

Further refer to FIG. 8, which is a schematic diagram illustrating the appearance of an embodiment of the position retainer. The first end 71 of the position retainer 7 is used for hanging the hair-drying hood 73 of the present invention, which has been inserted with a blower. A securing strap 80 may be provided at any position on the hair-drying hood 73 with the blower. The securing strap 80 in this embodiment is disposed on the blower, and may, of course, be alternatively disposed on the hair-drying hood 73. The securing strap 80 is attached to the first end 71 of the position retainer 7. The second end 72 can be designed as a reversed U-shaped hook for stabilizing the clip to be attached to an object 77, which may be a door panel or a partition of other furniture. In this way, the position retainer 7 can successfully play the role of fixing the hair-drying hood of the hair treatment device of the present invention in a proper working position.

Figure 5:
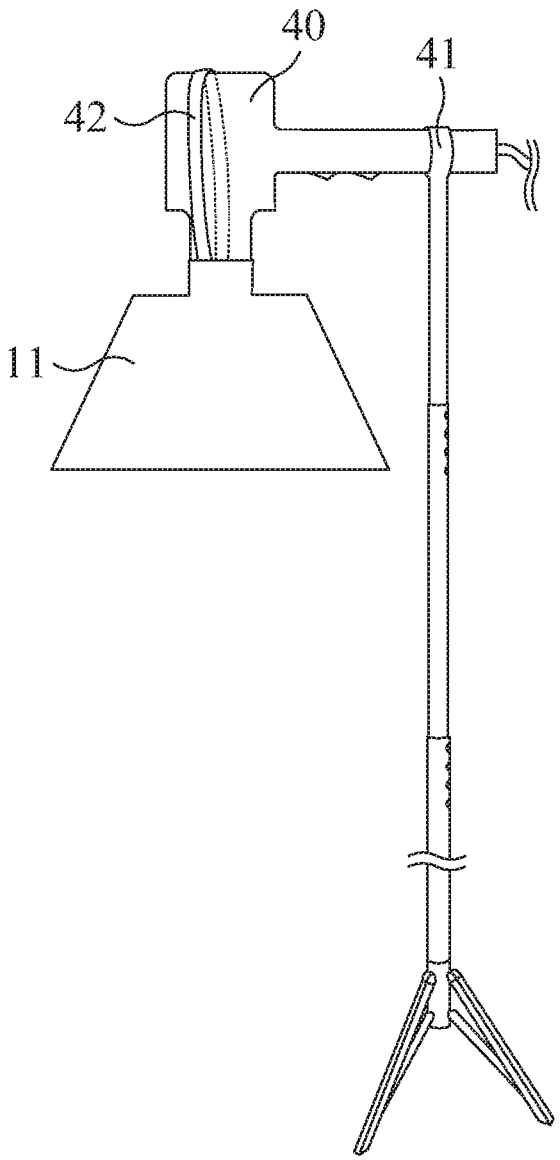
FIG. 5 is a schematic diagram illustrating the use of a hair treatment device assembled from a hair-drying hood of the present invention and a blower.
Figure 9:
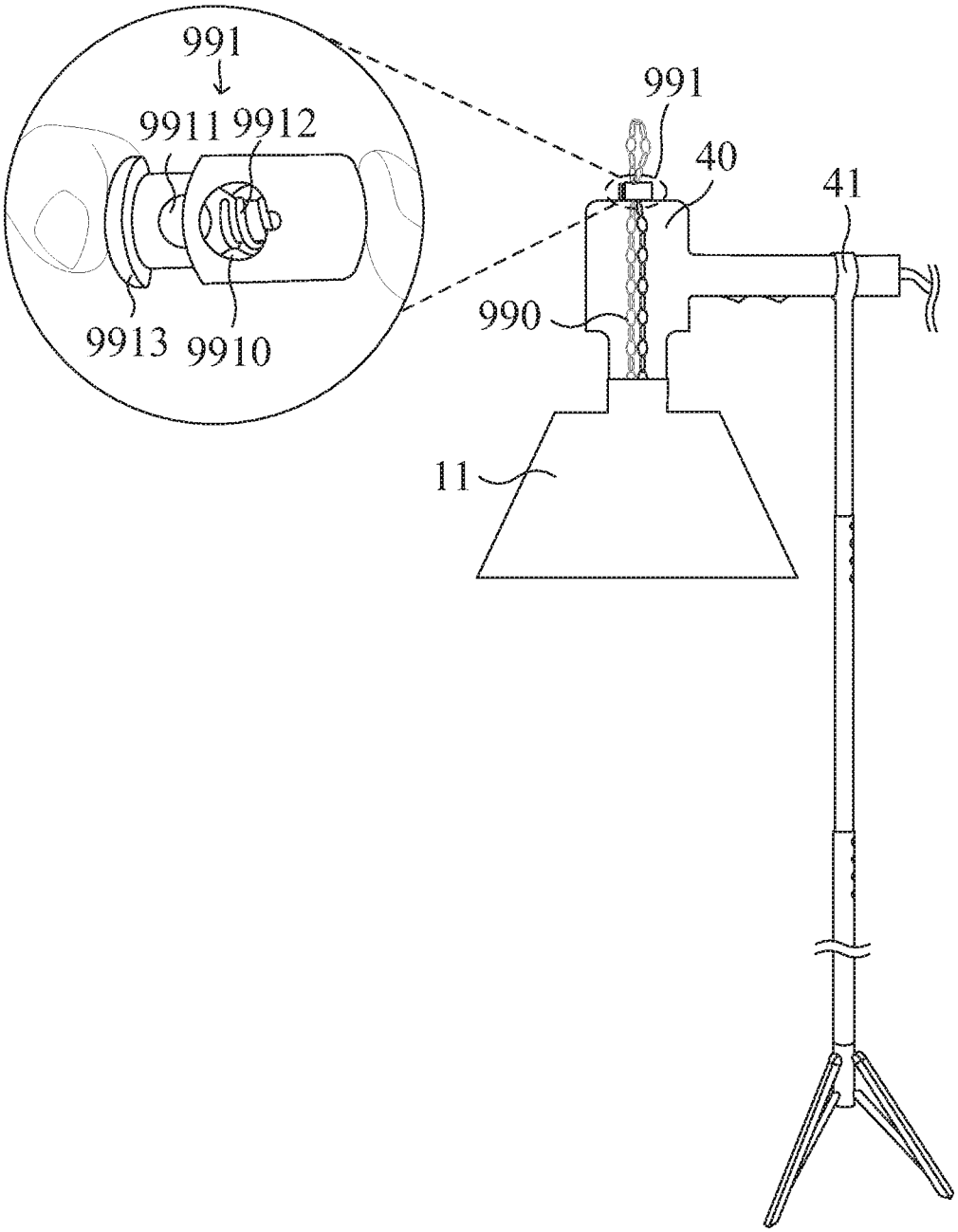
FIG. 9 is a schematic diagram illustrating an alternative embodiment of an elastic securing strap shown in FIG. 5 and FIG. 6.

Refer further to FIG. 9, which is a schematic diagram of an alternative arrangement in lieu of the elastic securing straps 42 and 52 as shown in FIG. 5 and FIG. 6. The securing strap 990 may be made of a non-elastic material, while a spring buckle 991 is alternatively applied. The securing strap 990 passes through a hole 9910 of the spring buckle 991 and aligned with another hole 9911 of a sliding block 9913 by pushing the sliding block 9913 with an external force, thereby adjusting the relative position of the fixing strap 990 and the spring buckle 991. After the external force is released, the spring 9912 will push the sliding block 9913 back to the original position so as to secure the relative position of the fixing strap 990 and the spring buckle 991. In addition, the elastic strap 12 shown in the above-mentioned FIG. 2A and FIG. 2C may also be implemented with the combination of the securing strap 990 and the spring buckle 991 as shown in FIG. 9.

While the invention has been described above by way of preferred embodiments, it is not intended to limit the invention. Those skilled in the art can make some modifications and improvements without departing from the spirit and scope of the invention. Therefore, the scope of the invention is defined by the scope of the appended claims.

What is claimed is:

1. A hair treatment device for use with a blower, comprising:

a hair-drying hood for covering the head of a user, the hair-drying hood having an opening at a top portion or a side portion thereof, from which the blower is inserted, and further comprising an outer layer, where the opening is disposed, and a thermal layer, which forms an air flow guiding chamber together with the outer layer in between for introducing and dispersing hot air from the blower all over the hair-drying hood while raising a temperature of the thermal layer; and a position retainer having a first end fixing the blower, and having a second end stably fixed onto an object, wherein the outer layer is further disposed therein with a frame structure, which is formed of a spiral wire, and the outer layer is expandable to switch from a retracted state to a working state while the spiral wire is stretching.

2. The hair treatment device according to claim 1, wherein an edge of the opening of the hair-drying hood is surrounded with a securing strap for assuring of fixing an air outlet of the blower to the hair-drying hood.

3. The hair treatment device according to claim 1, wherein two sides of the opening of the hair-drying hood are coupled with a securing strap for assuring of fixing the hair-drying hood to the blower.

4. The hair treatment device according to claim 1, wherein the outer layer is made of a heat-insulating material, and the thermal layer is distributed with a plurality of pores, which the hot air evenly penetrates through to reach hair of the user.

5. The hair treatment device according to claim 1, wherein the frame structure is formed of a spiral metal wire, and the spiral metal wire stretches as a result of gravity.

6. The hair treatment device according to claim 1, wherein the thermal layer is not porous, but is heat-conductive itself so that heat energy can be radiated evenly to hair, and the thermal layer is disposed with an outlet at a bottom portion thereof, where the outer layer is coupled, for exhausting air.

7. The hair treatment device according to claim 1, wherein a coupling position of the outer layer and the thermal layer are coupled thereto a net structure or a plurality of strings, and the coupling position is near the opening at the top portion of the hair-drying hood.

8. The hair treatment device according to claim 1, wherein the hair-drying hood further includes an air flow passage structure, which has an air inlet in communication with the opening, an air outlet in communication with the air flow guiding chamber for guiding hot air inputted from the air inlet toward the air flow guiding chamber, and a stopper structure, disposed at a bottom portion of the air inlet for stopping a front end of the blower from entering deep.

9. The hair treatment device according to claim 1, wherein the position retainer is a stand fixed on to a floor, and a height thereof is adjustable, and an orientation of the blower is changeable by rotating the first end fixing the blower.

10. The hair treatment device according to claim 1, wherein the second end of the position retainer is configured as a powerful spring clip for stably clamping the object, and wherein a main body between the first end and the second end is a tubular body, which can be secured in a bent shape and is resilient to deformation.

11. The hair treatment device according to claim 1, wherein the first end of the position retainer is configured for hanging the hair-drying hood inserted therein the blower, and the second end is configured as a reversed U-shaped hook for stably clamping the object, which is a door plate.

12. A hair-drying hood for use with a blower, comprising:

an outer layer having an opening at a top portion or a side portion thereof for inserting therefrom the blower;

a thermal layer forming an air flow guiding chamber together with the outer layer in between for introducing and dispersing hot air from the blower all over the hair-drying hood while raising a temperature of the thermal layer, and the outer layer and the thermal layer are switchable between a retracted state and a working state; and a frame structure, which is formed of a spiral wire, and the outer layer is expandable to switch from the retracted state to the working state while the spiral wire is stretching.

13. The hair-drying hood according to claim 12, wherein the frame structure is formed of a spiral metal wire, and the spiral metal wire stretches as a result of gravity.

14. The hair-drying hood according to claim 12, wherein an edge of the opening is surrounded with a first securing strap for fixing an air outlet of the blower to the hair-drying hood, and wherein two sides of the opening are disposed with a second securing strap for fixing the hair-drying hood to the blower.

15. The hair-drying hood according to claim 12, wherein the outer layer is made of a heat-insulating material, and the thermal layer is distributed with a plurality of pores, which the hot air evenly penetrates through to reach hair of the user.

16. The hair-drying hood according to claim 12, wherein the thermal layer is not porous, but is heat-conductive itself so that heat energy can be radiated evenly to hair, and the thermal layer is disposed with an outlet at a bottom portion thereof, where the outer layer is coupled, for exhausting air.

17. The hair-drying hood according to claim 12, wherein a coupling position of the outer layer and the thermal layer are coupled thereto a net structure or a plurality of strings, and the coupling position is near the opening at the top portion of the hair-drying hood.

18. The hair-drying hood according to claim 12, wherein the hair-drying hood further includes an air flow passage structure, which has an air inlet in communication with the opening, an air outlet in communication with the air flow guiding chamber for guiding hot air inputted from the air inlet toward the air flow guiding chamber, and a stopper structure, disposed at a bottom portion of the air inlet for stopping a front end of the blower from entering deep.

* * * * *